United States Patent [19]

Clavel

[11] 4,299,505

[45] Nov. 10, 1981

[54] SHIFT MECHANISM

[76] Inventor: Raymond Clavel, 3, rue Elie Bertrand, 1400 Yverdon (Vaud), Switzerland

[21] Appl. No.: 165,124

[22] PCT Filed: Feb. 6, 1979

[86] PCT No.: PCT/CH79/00015

§ 371 Date: Oct. 7, 1979

§ 102(e) Date: Jul. 19, 1979

[87] PCT Pub. No.: WO79/00597

PCT Pub. Date: Aug. 23, 1979

[30] Foreign Application Priority Data

Feb. 7, 1978 [CH] Switzerland ..... 1324/78

[51] Int. Cl.[3] ..... B41J 25/24; B41J 5/22

[52] U.S. Cl. ..... 400/258; 400/663

[58] Field of Search ..... 400/251, 252, 253, 258, 400/663

[56] References Cited

U.S. PATENT DOCUMENTS 3,157,265 11/1964 Palmer ..... 400/257 X
3,386,554 6/1968 Everhard ..... 400/258 X
3,554,348 1/1971 Herrmann ..... 400/253 X
3,565,231 2/1971 Dannatt ..... 400/251
3,972,404 8/1976 Menzi et al. ..... 400/258

OTHER PUBLICATIONS

IBM Tech. Disc. Bulletin, vol. 19, No. 7, Dec. 1976, pp. 2614–2615, 400–258.

*Primary Examiner*—Paul T. Sewell
*Attorney, Agent, or Firm*—Emory L. Groff, Jr.

[57] ABSTRACT

The invention concerns a shift mechanism for typewriters having a carriage in which the shift instruction is transmitted by two distinct interlocks of which one is in an active position when the other is in an inactive position. Each interlock is controlled by a primary lever and an auxiliary lever which causes it to work in connection with drive means serving to place it in an active position. A stirrup-shaped pivotal part is provided with two principal elements, one of which comprises the auxiliary lever controlling a first one of the interlocks, and the other element comprising an arm capable of being driven by the second interlock, the latter being normally controlled by the primary lever connected to a key on a keyboard.

4 Claims, 4 Drawing Figures

Fig. 2
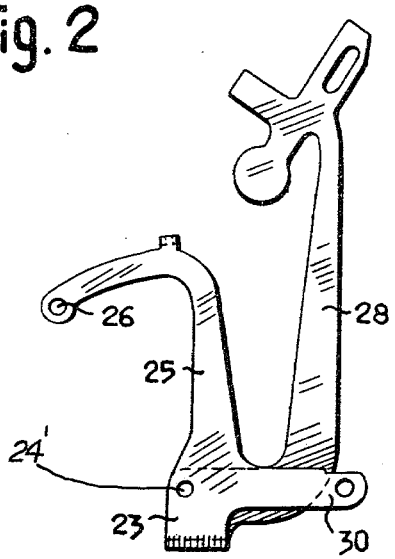
Fig. 3
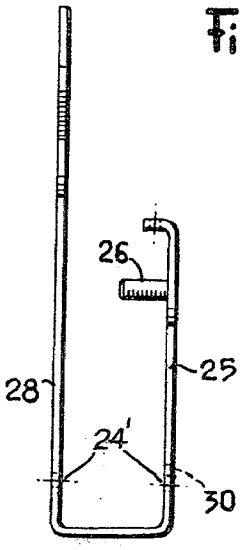
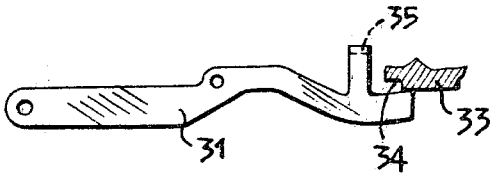
Fig. 4

SHIFT MECHANISM

The invention relates to a shift mechanism for typewriter comprising train bearing a printing element in which the shift order is transmitted to the train by two distinct interlocks, of which one corresponds to the upper case and the other to the lower case letters, one interlock being in active position when the other is in inactive position, each of said interlocks being controlled by a lever equipped with a catch to displace the interlock and cause it to work in connection with drive means which place it in the active position.

Shift mechanisms of this type are known in which interconnection means between one interlock and the lever of the other are constituted, for example, by an intermediate part driven by the "upper case" interlock in translation and activating said lever of the "lower case" interlock by means of a reversible ramp which introduces significant friction into the transmission of movement.

The purpose of the invention is to provide a shift mechanism of very simple construction which will not need adjustment. This goal is attained under the invention by virtue of the fact that the auxiliary lever controlling a first interlock is constituted by a portion of a pivotal part constructed in the form of a stirrup, the other or primary arm of which is capable of being driven by the second interlock, this latter normally being controlled by a primary level working in connection with a keyboard shift key.

The attached drawing represents schematically and by way of example one form of execution of the shift mechanism subject of the invention.

FIGS. 2 and 3 are respectively an elevated view and a side view of one part of said mechanism.

FIG. 4 is an elevated view of a detail of the mechanism.

Figure 1:
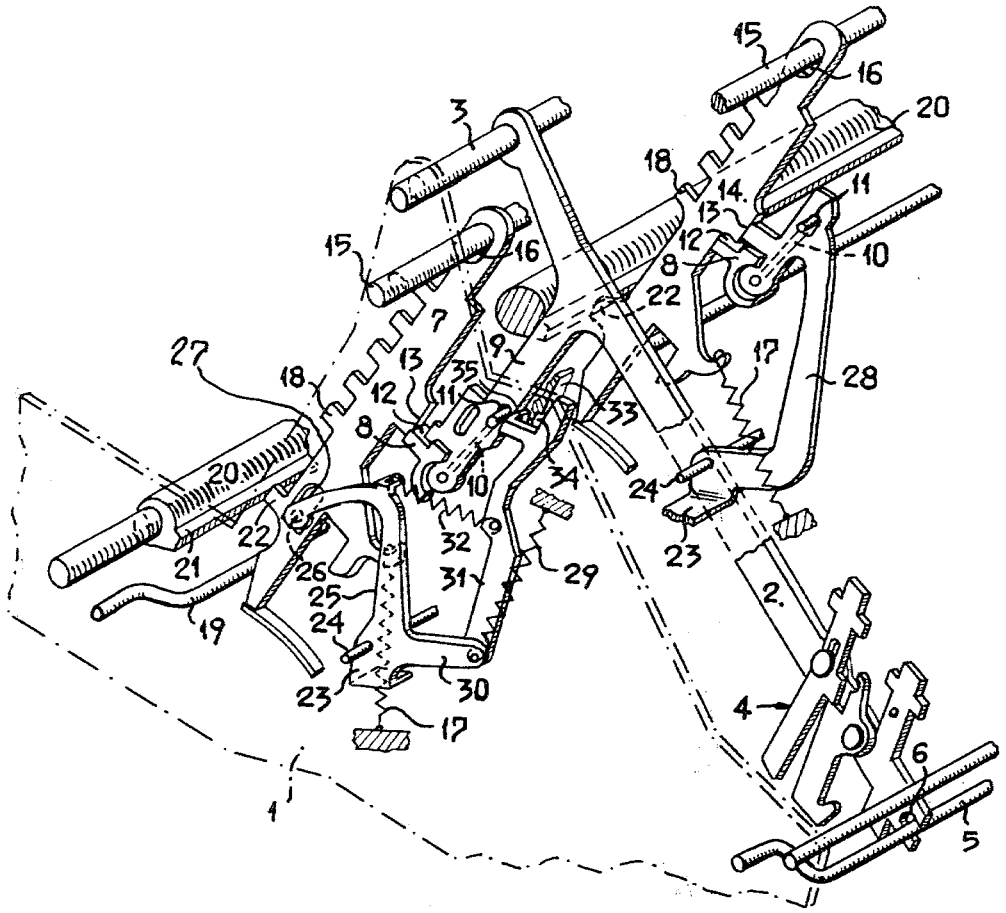
FIG. 1 is a perspective view of said mechanism.

The shift mechanism illustrated is intended to equip a typewriter of which only the left side wall 1 of the body is represented (in dotted lines). The typewriter is of the type comprising a train equipped with a printing element moving parallel to the platen. These elements are well known and have not been represented in the drawing it being understood that the present invention comprises an improvement over the mechanism described in U.S. Pat. No. 3,972,404 dated Aug. 3, 1976.

The shift mechanism comprises a pair of primary levers 2 controlling the "upper case" shift and arranged respectively at the left and right of the machine. (Only the left lever is represented in the drawing.) Said levers 2 are mounted so as to pivot around shaft 3 extending across the entire width of the machine and affixed to the upper part of the side walls of the body. Each of these levers is equipped with a key (not shown) arranged in the usual manner on the left and right of the keyboard of said machine. The pair of shift levers are equipped with a locking apparatus 4 for continuous upper case typing. This much of the apparatus is well known and will not be described.

Shift levers 2 are connected to each other in front by a universal bar 5 which is engaged in slot 6 provided in each of the forward extremities of said levers.

Universal bar 5 is mounted so as to swivel on the lateral walls of the body. To the pair of levers 2 is connected an interlock 7 corresponding to the upper case, which works in connection with left lever 2 by means of a catch or pusher 8 and the extremity of vertical arm 9 of said lever. Said catch 8 may pivot around said extremity by being submitted to the elastic force exercised by torsion spring 10 engaged in slot 11 of arm 9. Surface 12 of catch 8 may contact a tooth 13 of interlock 7.

An interlock 14 corresponding to the lower case is placed beside interlock 7. For reasons of clarity in the drawing, the parts of the shift mechanism corresponding respectively to the upper case and to the lower case have been shown as being spread apart from each other.

Each of the interlocks is mounted substantially vertically upon shaft 15 engaged inside an oblong opening 16 provided in the upper part of the interlock. Shaft 15 is affixed to the lateral walls of the body and extends parallel to shaft 3.

Each interlock 7 and 14 sliding along oblong opening 16 may thus move essentially vertically up or down in the track corresponding to the length of said oblong opening. Each interlock is pulled in the course of this displacement by a return spring 17 which tends to pull it downward. Each interlock is equipped in known fashion with protrusions 18 capable of activating universal bars (not shown) intended to transmit the various coded shift instructions to the train of the machine. Interlocks 7 and 14 may work in connection with a universal bar 19 mounted so as to swivel in the lateral walls of the body. Said universal bar 19 is capable of activating drive means in the form of a preselection shaft 20 by means of a connecting gear (not shown). Shaft 20 pivots on the lateral walls of the body and extends across the entire width of the machine. It comprises a longitudinal shelf 21 capable of working in connection with a protrusion 22 provided on the lower part of each interlock 7 and 14.

A part 23 in the form of a U-shaped member or stirrup is pivotally mounted about an axis 24 affixed to the body of the machine parallel to shaft 3. This pivotal mounting occurs as at 24'—24' and the preferably unitary part 23 is shown most clearly in FIGS. 2 and 3 of the drawings. Said part 23 constitutes on the one hand an arm 25 having a finger 26 engaged in an oblong slot 27 in interlock 7 corresponding to the upper case, and on the other hand an auxiliary lever 28 capable of working in connection with interlock 14 corresponding to the lower case.

Auxiliary lever 28 is capable of activating interlock 14 through means identical to those used for left lever 2 and designated by the same numerical references: pivotal catch 8, pulled by torsion spring 10 and displacing tooth 13 of interlock 14 by means of surface 12.

A return spring 29 affixed to an arm 30 of part 23 tends to cause the latter part to pivot in counterclockwise direction (FIG. 1). At the extremity of arm 30 is mounted a pivotal key 31 drawn by a spring 32 in the direction of arm 25. The upper extremity of key 31 is capable of resting against a catch 33, integral with the body and including a tooth 34, and working in connection with vertical arm 9 of lever 2 by means of a bend or offset portion 35. The catch 33 and tooth 34 thus will be seen to comprise retaining means serving to lock the part 23 against the force of the spring 29.

The shift mechanism described functions in the following manner:

When the operator depresses one of the two upper case primary levers 2 by pressing the left or right shift key of the keyboard, catch 8 of lever 2 causes upper case interlock 7 to pivot forward slightly around shaft 15. Upon such movement, interlock 7 causes universal bar 19 to swivel, setting in motion the preselection shaft 20 for one turn. Said shaft, by its shelf 21, causes interlock 7 to rise to the limit of oblong opening 16, so that said interlock transmits to the train, through protrusions 18 and the corresponding universal bars, the coded instructions necessary for the upper case shift. Shelf 21, after a rotation of approximately 30°, releases interlock 7, which is drawn back by spring 17. Tooth 13 of the interlock then makes contact with surface 12 of the pusher or catch 8 (which pivots in counterclockwise direction) at the extremity of the primary lever vertical arm 9, thus cocking torsion spring 10.

During the rise of interlock 7, driven by preselection shaft 20, part 23, driven by means of finger 26 (engaged in opening 27 in interlock 7), pivots in a clockwise direction. In the course of this movement, spring 29 is cocked and the extremity of key 31, drawn back by spring 32, is engaged in tooth 34 of catch 33. Surface 12 of catch 8, located at the extremity of the stirrup part auxiliary lever 28 resumes its rest position by means of the force of its torsion spring 10, so that catch 8 is ready to transmit a new function.

When primary lever 2 is released, its vertical arm 9 comes to rest against bend or offset portion 35 in key 31 and disengages the extremity of said key from tooth 34 of cath 33. Part 23 is drawn back in a counterclockwise direction by spring 29, and auxiliary lever 28, through its catch 8, causes interlock 14 to pivot slightly forward. Interlock 14 transmits its coded instructions to the train in the same way as interlock 7.

It should be noted that in the mechanism described, spring 29 is cocked by preselection shaft 20, which enables considerable reduction of the touch pressure on the shift keys.

Furthermore, spring 29 need not overcome extraneous friction effects of the sort caused by a reversible ramp, and the total inertia of the parts driven by said spring is very low, so that the shift return is quite rapid. In addition, with the shift return being performed by a single part 23, assembly is simplified and no adjustment is necessary.

Numerous variants of the invention are foreseen. In particular, part 23 might be embodied in two parts made integral during assembly, or key 31 and spring 32 might be replaced by a leaf spring made integral with parts 23 and working in connection with catch 33 and offset portion 34 by virtue of its own elasticity.

I claim:

1. In a typewriter having a carriage, a shift mechanism including first and second displaceable interlocks respectively corresponding to the lower and upper case, one said interlock being in an active position when the other said interlock is in an inactive position, a primary lever and auxiliary lever each having a pusher respectively engageable with said second and first interlocked, drive means adjacent said interlocks, said interlocks displaceable by said pushers into engagement with said drive means for placing said interlocks in an active position, a pivotally mounted U-shaped part with one portion thereof comprising said auxiliary lever, another portion of said U-shaped part comprising an arm drivingly connected to said second interlock, spring means engaging said U-shaped part to urge said auxiliary lever toward said first interlock, retaining means including a catch engageable by said U-shaped part to limit the pivotal movement of said U-shaped part against the force of said spring means, and said second interlock controllable upon actuation of said primary lever.

2. A typewriter according to claim 1 including, a finger adjacent the extremity of said U-shaped part arm, and said second interlock having an opening receiving said finger.

3. A typewriter according to claim 1 including, a key carried by said U-shaped part and engageable with said catch, and said catch including a tooth engageable by said key.

4. A typewriter according to claim 3 wherein, said key including an offset portion engageable by said primary lever to control said second interlock when in an inactive position whereby, said primary lever when in an inoperative position disengages said key from said catch tooth.

* * * * *